US009909576B2

(12) United States Patent
Brown et al.

(10) Patent No.: US 9,909,576 B2
(45) Date of Patent: Mar. 6, 2018

(54) PUMP DRIVE SYSTEM WITH HYDRAULIC TAPPETS

(71) Applicant: Caterpillar Inc., Peoria, IL (US)

(72) Inventors: Cory A. Brown, Peoria, IL (US); Bryan E. Nelson, Chillicothe, IL (US); Dana R. Coldren, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 461 days.

(21) Appl. No.: 14/603,898

(22) Filed: Jan. 23, 2015

(65) Prior Publication Data

US 2016/0215766 A1 Jul. 28, 2016

(51) Int. Cl.

| | |
|---|---|
| ***F04B 9/109*** | (2006.01) |
| ***F04B 1/16*** | (2006.01) |
| ***F04B 15/08*** | (2006.01) |
| ***F04B 53/14*** | (2006.01) |
| ***F04B 19/22*** | (2006.01) |
| ***F04B 53/16*** | (2006.01) |
| ***F04B 37/08*** | (2006.01) |
| ***F04B 39/00*** | (2006.01) |

(52) U.S. Cl.

CPC ..... *F04B 9/109* (2013.01); *F04B 1/16* (2013.01); *F04B 15/08* (2013.01); *F04B 19/22* (2013.01); *F04B 37/08* (2013.01); *F04B 39/0005* (2013.01); *F04B 53/14* (2013.01); *F04B 53/16* (2013.01); *F04B 2015/081* (2013.01)

(58) Field of Classification Search

CPC ..... F04B 9/109; F04B 39/005; F04B 37/08; F04B 1/14; F04B 1/16; F04B 1/126; F04B 15/08; F04B 19/22; F04B 53/14; F04B 53/16; F04B 2015/081

See application file for complete search history.

(56) References Cited

U.S. PATENT DOCUMENTS

| | | | | |
|---|---|---|---|---|
| 2,578,746 | A * | 12/1951 | Scherger | F04B 43/067 417/383 |
| 3,830,594 | A | 8/1974 | Hein et al. | |
| 3,873,240 | A * | 3/1975 | Leduc | F04B 1/14 417/222.1 |
| 3,961,860 | A | 6/1976 | Ernst | |
| RE29,055 | E | 11/1976 | Wagner | |
| 4,028,010 | A | 6/1977 | Hopkins | |
| 4,036,195 | A | 7/1977 | Bailey | |
| 4,403,924 | A | 9/1983 | Gebauer et al. | |

(Continued)

*Primary Examiner* — Nathan Zollinger

(74) *Attorney, Agent, or Firm* — Leydig, Voit & Mayer, LTD.

(57) ABSTRACT

A cryogenic pump comprising a shaft disposed in a bearing. The shaft rotates with respect to the bearing housing, and the shaft includes an end with an angled face. The pump includes a drive at one end of the bearing housing. A tappet passage is formed through the drive housing. A pushrod housing connects to the drive housing. The pump includes a piston and a tappet sliding within the tappet passage. The tappet has a base end disposed within the tappet passage and a rod end extending below the tappet end of the drive housing. A fluid cavity is in the tappet passage between the piston and the tappet. The pump includes a pushrod connected to the tappet. The angled face of the shaft rotates and drives the piston toward the drive housing, pushing fluid within the fluid cavity against the tappet, driving the pushrod away from the drive housing.

19 Claims, 4 Drawing Sheets

(56) References Cited

U.S. PATENT DOCUMENTS

| | | | | |
|---|---|---|---|---|
| 4,426,914 | A | 1/1984 | Kline | |
| 4,443,160 | A * | 4/1984 | Berthold | F04B 1/14 417/270 |
| 4,792,289 | A | 12/1988 | Nieratschker | |
| 4,984,970 | A | 1/1991 | Eickmann | |
| 5,511,955 | A | 4/1996 | Brown et al. | |
| 5,572,919 | A | 11/1996 | Ishizaki | |
| 5,862,704 | A | 1/1999 | Sljestad | |
| 6,264,437 | B1 | 7/2001 | Porel | |
| 7,416,045 | B2 * | 8/2008 | Gleasman | B60K 17/105 180/305 |

* cited by examiner

PUMP DRIVE SYSTEM WITH HYDRAULIC TAPPETS

TECHNICAL FIELD

This patent disclosure relates generally to cryogenic pumps and, more particularly, to drive systems for cryogenic pumps.

BACKGROUND

Use of liquefied gas as a fuel source for various applications has gained popularity in recent years due to the lower cost and cleaner burning of gaseous fuels such as liquefied petroleum gas (LPG), compressed natural gas (CNG), or liquefied natural gas (LNG), as compared to more traditional fuels such as gasoline or diesel. In practical applications, for example, mining trucks, locomotives, highway trucks and the like, to gain sufficient range between refueling, the gaseous fuel is stored and carried on-board the vehicle in a liquefied, pressurized, cryogenic state.

Some applications require the handling, and more particularly the pumping, of cryogenic liquids. For example, heavy machines like locomotives or large mining trucks may have engines that use more than one fuel. The engine may be a dual fuel engine system, in which a gaseous fuel, such as compressed natural gas, is injected into a cylinder at high pressure while combustion in the cylinder from an ignition source, such as a diesel pilot, is already underway. With such engines, the fuel may be stored at low, cryogenic temperatures and relatively high pressures in a storage tank in order to achieve a higher storage density, and vaporized into a gaseous form by a heat exchanger before it is introduced into the engine. However, the use of such a cryogenic fuel requires the use of specialized equipment, including a cryogenic tank for storing the liquefied natural gas ("LNG") fuel and a cryogenic pump for withdrawing and pressurizing the liquefied natural gas fuel.

U.S. Pat. No. 4,443,160 ("the '160 patent") describes one example of a high-pressure pump for liquids. More specifically, the '160 patent describes using pressure in a piston/tappet assembly to adjust the angle of a swash plate. The arrangement described in the '160 patent as well as other traditional arrangements for drive systems for high pressure pumps used in the types of applications describe above involve complicated bearing assemblies and load plates that expose the components to wear and add to the size of the overall pump. Additionally, pumps like those described above often include various external components, such as oil tanks and pumps, to provide lubrication to the internal components of the pump. These external components add to the space required to use the pump and add complexity to the pump system.

SUMMARY

The disclosure describes, in one aspect, a cryogenic pump comprising a bearing housing having a shaft end and a drive end, and a shaft having an upper end and a lower end disposed in the bearing housing at the shaft end. The shaft is rotatable with respect to the bearing housing about a longitudinal axis, and the lower end of the shaft includes an angled face oriented transverse to the longitudinal axis. The cryogenic pump includes a drive housing having a piston end and a tappet end. The drive housing is disposed at the drive end of the bearing housing. At least one tappet passage is formed through the drive housing substantially along the longitudinal axis between the piston end and the tappet end. A pushrod housing is connected to the tappet end of the drive housing. The cryogenic pump includes at least one piston slidably disposed at least partially within the at least one tappet passage. A cavity end of the piston is disposed within the tappet passage. The cryogenic pump includes at least one tappet slidably disposed at least partially within the at least one tappet passage. The at least one tappet has a base end disposed within the tappet passage and a rod end extending below the tappet end of the drive housing. A fluid cavity substantially filled with a fluid is formed in the tappet passage between the cavity end of the piston and the base end of the tappet. The cryogenic pump includes at least one pushrod disposed within the pushrod housing and connected to the rod end of the at least one tappet. During an extend stroke, the angled face of the shaft rotates and drives the at least one piston toward the tappet end of the drive housing so as to push the fluid within the fluid cavity against the base end of the at least one tappet thereby driving the at least one tappet to drive the at least one pushrod away from the drive housing into an extended position.

In another aspect, the disclosure describes a drive system for a cryogenic pump including a bearing housing, a drive housing connected to the bearing housing. The drive housing has a piston end and a tappet end. The cryogenic pump includes a pushrod housing connected to the piston end of the drive housing. The drive system comprises a shaft configured to rotate about a longitudinal axis within the bearing housing. The shaft has an upper end and a lower end, where the lower end includes an angled face oriented transverse to the longitudinal axis. The drive system includes at least one piston configured to slide at least partially within a tappet passage formed between the piston end and the tappet end of the drive housing. A cavity end of the piston is disposed within the tappet passage. The drive system includes at least one tappet slidably disposed at least partially within the at least one tappet passage. The at least one tappet has a base end disposed within the tappet passage and a rod end extending below the tappet end of the drive housing. A fluid cavity substantially filled with a fluid is formed in the tappet passage between the cavity end of the piston and the base end of the tappet. The drive system includes at least one pushrod disposed within the pushrod housing and connected to the rod end of the at least one tappet. The at least one pushrod is configured to pump cryogenic fluid. During an extend stroke, the angled face of the shaft rotates and drives the at least one piston toward the tappet end of the drive housing so as to push the fluid within the fluid cavity against the base end of the at least one tappet thereby driving the at least one tappet to drive the at least one pushrod away from the drive housing into an extended position.

In another aspect, the disclosure describes a cryogenic pump comprising a bearing housing having a shaft end and a drive end. The cryogenic pump includes a drive housing having a piston end and a tappet end, where the drive housing is disposed at the drive end of the bearing housing and at least one tappet passage is formed through the drive housing substantially along the longitudinal axis between the piston end and the tappet end. The cryogenic pump includes a pushrod housing connected to the tappet end of the drive housing, and a manifold connected to the pushrod housing. The manifold forms at least one pushrod passage. The cryogenic pump includes a shaft having an upper end and a lower end disposed in the bearing housing at the shaft end and rotatable with respect to the bearing housing about a longitudinal axis. The lower end of the shaft includes an angled face oriented transverse to the longitudinal axis. The cryogenic pump includes at least one piston slidably disposed at least partially within the at least one tappet passage, where a cavity end of the piston is disposed within the tappet passage and a slipper end of the piston extends above the piston end of the drive housing. The piston includes a piston fluid channel running between the cavity end and the slipper end. The cryogenic pump includes at least one tappet slidably disposed at least partially within the at least one tappet passage. The at least one tappet has a base end disposed within the tappet passage and a rod end extending below the tappet end of the drive housing. A fluid cavity substantially filled with a fluid is formed in the tappet passage between the cavity end of the piston and the base end of the tappet. The cryogenic pump also includes at least one slipper rotatably connected to the slipper end of the at least one piston. The at least one slipper is disposed between the piston and the angled face of the shaft so as to slide along the angled face when the shaft rotates. The slipper includes a slipper fluid channel in fluid communication with the piston fluid channel. The piston fluid channel and the slipper fluid channel provide fluid communication between the fluid cavity and a slipper interface formed between the slipper and the angled face of the shaft. The cryogenic pump includes at least one check valve providing selective fluid communication between a fluid reservoir and the fluid cavity. The check valve is configured to allow fluid to flow into the fluid cavity when the pressure within the fluid cavity is lower than the pressure within the fluid reservoir. The cryogenic pump also includes at least one pushrod disposed within the pushrod housing and connected to the rod end of the at least one tappet, at least a portion of the at least one pushrod slidably disposed within the pushrod passage formed in the manifold. The cryogenic pump also includes at least one pushrod spring disposed between the manifold and the at least one pushrod so as to bias the pushrod toward the drive housing. During an extend stroke, the angled face of the shaft rotates and drives the at least one piston toward the tappet end of the drive housing so as to push the fluid within the fluid cavity against the base end of the at least one tappet thereby driving the at least one tappet to overcome the pushrod spring and drive the at least one pushrod away from the drive housing into an extended position. During a retract stroke, the at least one pushrod spring drives the at least one pushrod toward the drive housing so as to push the tappet toward the piston end of the drive housing, thereby pushing the fluid within the fluid cavity against the cavity end of the at least one piston to drive the slipper end of the piston away from the drive housing and into a retracted position.

DETAILED DESCRIPTION

Figure 1:
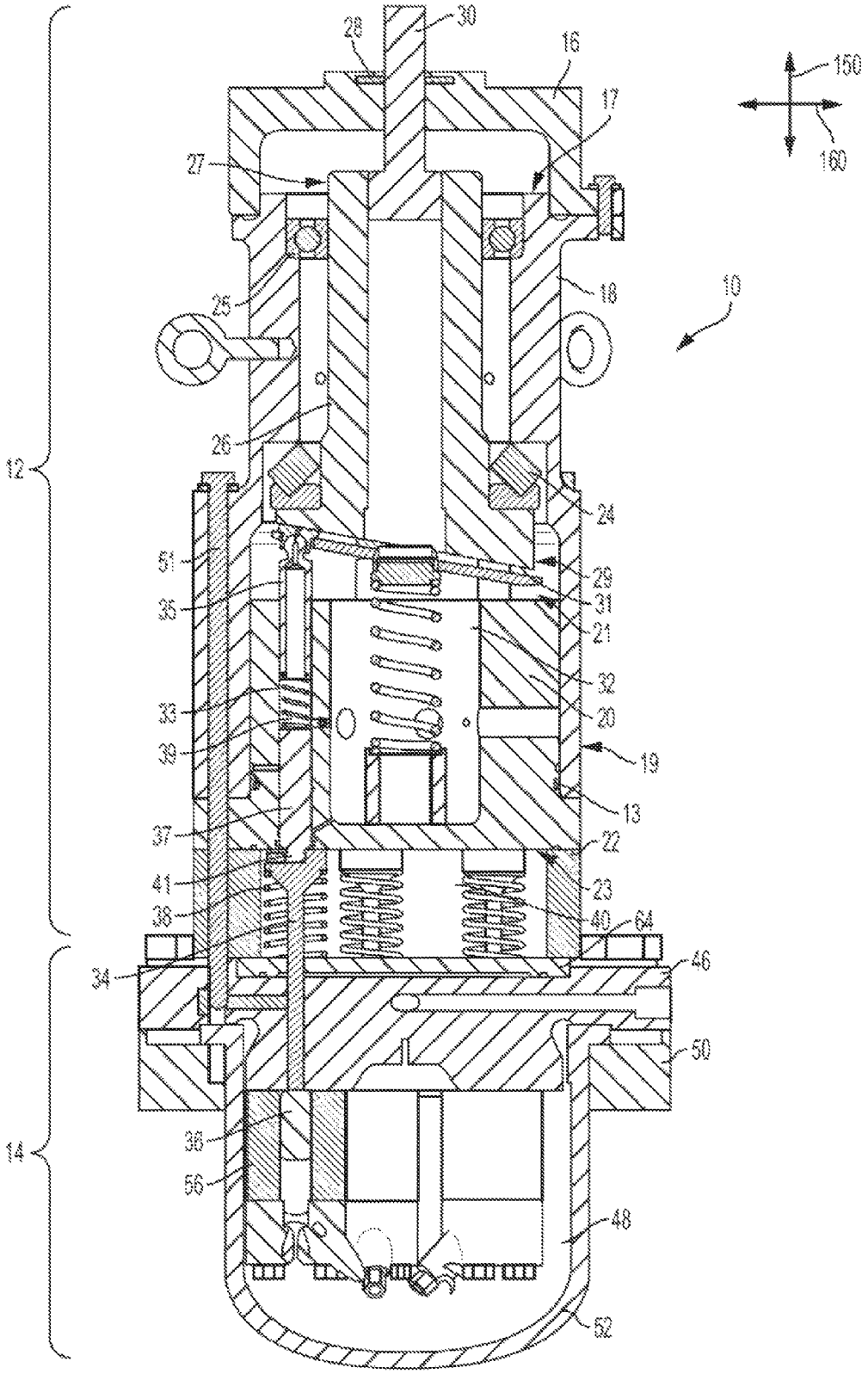
FIG. 1 is a side sectional view of an exemplary cryogenic pump according to the disclosure.

This disclosure generally relates to a cryogenic pump 10 and, more particularly, to a drive system that translates rotational movement of a shaft into linear movement of a plurality of pushrods to pump high pressure fluid, such as LNG. With reference to FIG. 1 of the drawings, an exemplary cryogenic pump 10 according to the present disclosure is shown. The cryogenic pump 10 of FIG. 1 may be configured to pump fluids at cryogenic temperatures, such as temperatures of less than minus 100 degrees Celsius. In one exemplary embodiment, the cryogenic pump 10 can be configured as a pump for receiving LNG from a source, pressurizing it, and delivering the LNG to an engine at high pressure. LNG is normally stored at temperatures of between about minus 240 degrees F. (minus 150 degrees C.) and minus 175 degrees F. (minus 115 degrees C.) and at pressures of between about 15 and 200 psig (204 and 1477 kPa) in a cryogenic tank. The engine, for example, may be on a machine such as a large mining truck or a locomotive. The high pressure LNG from the cryogenic pump may be vaporized into a gaseous form by a heat exchanger before it is introduced into the engine. Of course, those skilled in the art will appreciate that the cryogenic pump 10 of the present disclosure is not limited to applications involving the pumping of LNG or, more particularly, engine fuel delivery systems. Instead, the cryogenic pump 10 of the present disclosure can be used in any application involving the pumping of a cryogenic liquid. Further, it should be understood that the drive system of the disclosure may be used in applications other than cryogenic pumps, for example, pumps for pumping non-cryogenic liquid.

With reference to FIG. 1 of the drawings, for purposes of illustration, a longitudinal axis 150 is shown perpendicular to a lateral axis 160. Although the cryogenic pump 10 illustrated in the figures is generally aligned along the longitudinal axis 150, it should be understood that this merely ease of description and illustration.

The cryogenic pump 10 may be generally configured with a warm end portion 12 and a cold end portion 14. In the illustrated embodiment, the cold end portion 14 of the cryogenic pump 10 is the lower portion of the pump and generally includes the pump components that are intended to come into contact with the cryogenic fluid during operation of the pump including a pump inlet and a pump outlet. The warm end portion 12 of the illustrated pump is the upper portion of the pump and generally includes one or more driving components of the pump that are not intended to contact the cryogenic fluid during operation of the pump. The components in the cold end portion 14 of the cryogenic pump 10 may be constructed of materials rated for cryogenic service, while the components in the warm end portion 12 may be constructed of conventional materials.

Figure 2:
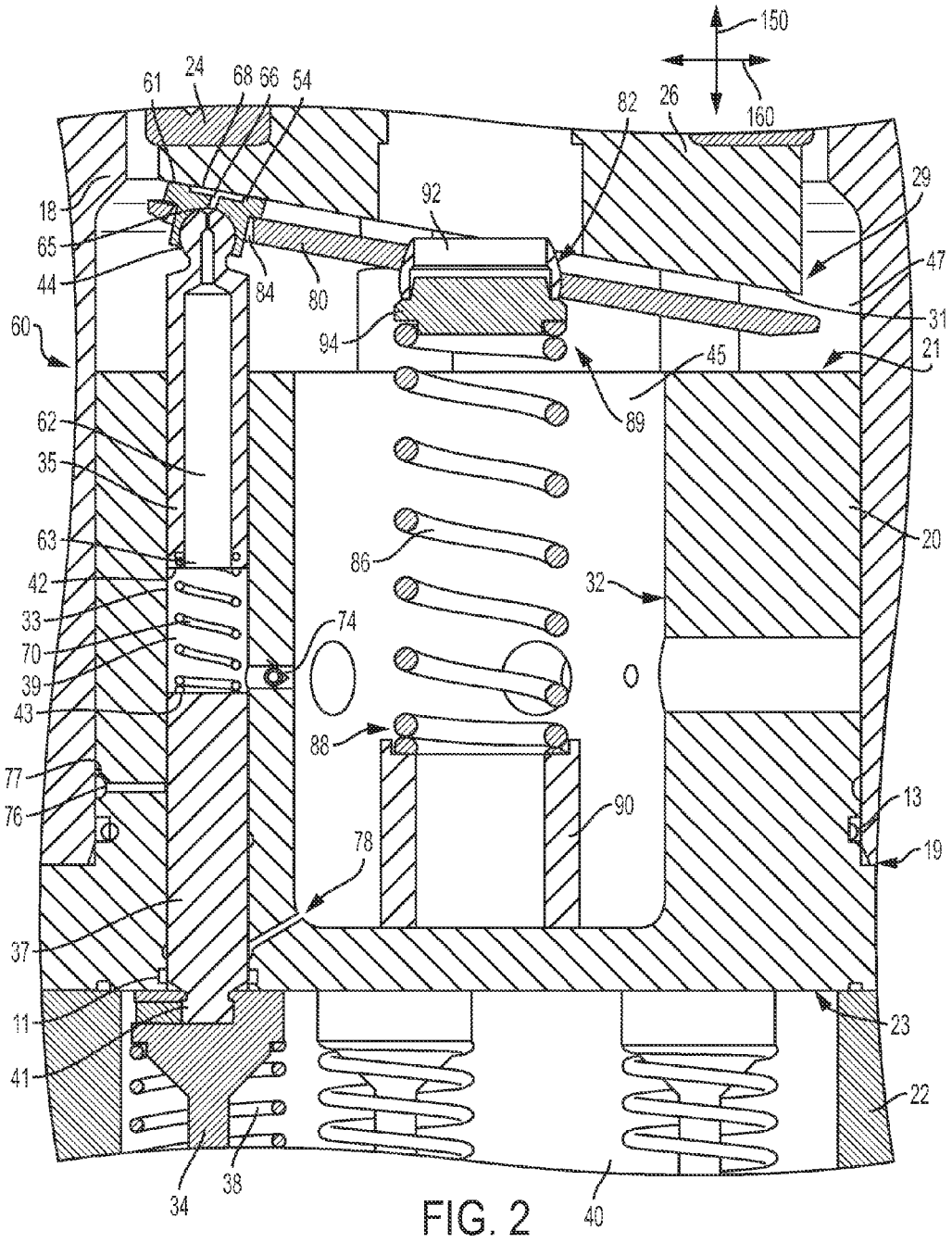
FIG. 2 is an enlarged partial side sectional view of the cryogenic pump of FIG. 1 showing a drive housing.

With reference to the cross-sectional view of FIG. 1, the warm end portion 12 of the pump may include a housing cap 16, a bearing housing 18, a drive housing 20 and a pushrod housing 22. Starting from the upper end of the cryogenic pump 10 as shown in FIG. 1, the housing cap 16 may be connected to a shaft end 17 of the bearing housing 18 while a drive end 19 of the bearing housing 18 is connected to the drive housing 20. In the illustrated embodiment, the drive housing 20 has a piston end 21 disposed within the drive end 19 of the bearing housing 18 and a tappet end 23 extending below the bearing housing. The tappet end 23 of the drive housing 20 may, in turn, be connected to the pushrod housing 22 which, in the illustrated embodiment, defines the lower end of the warm end portion 12 of the cryogenic pump 10. In some embodiments, the drive housing 20 includes a retainer bore 32 formed into the piston end 21 of the drive housing 20. As shown in FIG. 2, a fluid reservoir 45 is formed from the combined interior space 47 of the bearing housing 18 and the retainer bore 32. The fluid reservoir 45 may be substantially filled with oil or another suitable lubricating fluid that lubricates the bearings, shaft, and other moving parts exposed to the fluid reservoir 45. A plurality of seals 11, 13, and 28 (see FIG. 1) prevent excess fluid from leaking out of the fluid reservoir 45.

As further shown in FIG. 1, a rotatable shaft 26 may be contained within the bearing housing 18. The rotatable shaft 26 may be connected at its upper end 27 to a stub shaft 30 that protrudes outward from the housing cap 16. The stub shaft 30 may be operatively connected to any suitable prime mover capable of producing a rotary output such as, for example, an electric or hydraulic motor or a diesel or gasoline engine. The shaft 26 may be supported in the bearing housing 18 by, for example, an upper end bearing 25 and a lower end bearing 24, for rotatably supporting the shaft 26. Thus, the shaft 26 is disposed in the bearing housing 18 at the shaft end 17 and rotatable with respect to the bearing housing about a longitudinal axis 150. At a lower end 29 of the shaft 26 opposite the stub shaft 30, the shaft 26 may include an angled face 31 oriented transverse to the longitudinal axis 150, so as to act as a swash plate. The angled face 31 of the shaft 26 is oriented such that rotation of the shaft drives a wobbling movement of the angled face.

The drive housing 20 includes at least one tappet passage 33 formed through the drive housing substantially along the longitudinal axis between the piston end 21 and the tappet end 23. A piston 35 and a tappet 37 are slidably disposed at least partially within each tappet passage 33 such that a fluid cavity 39 filled with a fluid is formed within each tappet passage between the respective pistons and the tappets. As the shaft 26 rotates, the angled face 31 drives each piston 35 axially downward into the tappet passage 33 toward the fluid in the fluid cavity 39 such that the fluid drives the tappet 37 axially downward. Although only a single tappet passage 33 and respective piston 35, tappet 37, and fluid cavity 39 are visible in the cross-section of FIG. 1, it will be understood that additional tappet passages and respective components can be used. For example, some embodiments include five tappet passages 33 with five corresponding pistons 35, tappets 37, and fluid cavities 39 arranged in an annular pattern. Each of the pistons 35 and tappets 37 may have an elongate configuration and be supported for longitudinal movement in a respective tappet passage 33 in the drive housing 20.

A rod end 41 of each tappet 37 may engage a corresponding pushrod 34 that, in turn, engages at its lower end a corresponding plunger 36. In the cross-sectional view of FIG. 1, a total of three pushrods 34 are visible. However, it will be understood that respective pushrod 34 and plungers 36 may be provided for each tappet 37. Each pushrod 34 may be supported in the pushrod housing 22 for movement along the longitudinal axis 150 in response to a force applied at the upper end thereof by the tappet 37. The longitudinal movement of the pushrods 34, in turn, applies a force on the plungers 36 that drives movement of the respective plungers 36 along the longitudinal axis 150. In this case, downward movement of each tappet 37 and pushrod 34 may be counter to the force of a respective pushrod spring 38 arranged, for example, in a pushrod cavity 40 of the pushrod housing 22 that drives the pushrod 34 and tappet 37 back upward when the force applied by the angled face 31 is relieved by rotation of the shaft 26.

Referring to FIG. 1, the cold end portion 14 of the cryogenic pump 10 may include a manifold 46 and a cryogenic reservoir 48. More specifically, the manifold 46 may be arranged at the lower end of the pushrod housing 22, while the cryogenic reservoir 48 may be attached to the lower side of the manifold 46. To facilitate connection between the manifold 46 and the cryogenic reservoir 48, the cryogenic reservoir 48 may have an annular retainer 50 at the upper end thereof that abuts against an outer portion of the lower surface of the manifold 46 and is secured thereto, for example, by fasteners. The manifold 46, in turn, may be connected to the pushrod housing 22 by one or more tie rods 51 (one is shown in FIG. 1) that extend through the bearing housing 18, the drive housing 20 and the pushrod housing 22 and into the manifold 46.

The cryogenic reservoir 48 may include a outer vacuum jacket 52 and may house a plurality of barrels 56 each of which defines an inlet for the cryogenic pump 10. According to one embodiment, at least a portion of the barrel 56 may be submerged in cryogenic fluid contained in the cryogenic reservoir 48. Generally, each barrel 56 corresponds to a respective one of the tappet and pushrod combinations. Thus, while three barrels 56 are visible in the cross-sectional view of FIG. 1, it will be understood that the cryogenic pump 10 may have any number of barrels as well as correspond tappet and pushrod combinations. For example, the illustrated embodiment is configured to have a total of five barrels 56.

Each pushrod 34 may extend downward through a corresponding passage through the manifold 46 and into a corresponding one of the barrels 56 where it engages with a plunger 36 arranged in the barrel 56. With this arrangement, movement of the pushrod 34 (as driven by the angled face 31 of the shaft 26 through the corresponding piston 35, fluid in the fluid cavity 39, and tappet 37) can drive movement of the plunger 36. Movement of the plunger 36, in turn, can pressurize cryogenic fluid that has been fed into the barrel 56 from the cryogenic reservoir 48. The pressurized cryogenic fluid may then be directed into the manifold 46 which defines the outlet for the pressurized fluid from the cryogenic pump 10. In some embodiments, an insulator plate 64 may be arranged between the manifold 46 and the pushrod housing 22 to help limit the transfer of heat from the warm end portion 12 of the cryogenic pump 10 to the cold end portion 14.

Referring now to FIG. 2, the drive system 60, including the shaft 26 and at least one set of corresponding pistons 35, tappets 37, and pushrods 34 is shown in detail. Specifically, a piston 35 is slidably disposed at least partially within each tappet passage 33 with a cavity end 42 of the piston disposed within the tappet passage and a slipper end 44 of the piston extending above the piston end 21 of the drive housing 20. The corresponding tappet 37 is slidably disposed at least partially within each tappet passage 33. Each tappet 37 has a base end 43 disposed within the tappet passage 33 and a rod end 41 extending below the tappet end 23 of the drive housing 20. A fluid cavity 39 is formed within the tappet passage 33 between the cavity end 42 of the piston 35 and the base end 43 of the tappet 37. The fluid cavity 39 is substantially filled with a fluid, for example, oil, hydraulic fluid, or another suitable substantially incompressible fluid. As the pistons 35 and tappets 37 oscillate along the longitudinal axis 150 within their respective tappet passages 33, the fluid within the fluid cavity 39 oscillates in a corresponding manner. Because the fluid within each fluid cavity 39 is substantially incompressible, force applied downward by the rotating shaft 26 via the angled face 31 and the pistons 35 is transferred through the fluid in respective fluid cavity to the corresponding tappet 37. As described above, each tappet 37, in turn, drives each respective pushrod 34, which is connected to the rod end 41 of the tappet. In some embodiments, a pushrod spring 38 may concentrically surround each pushrod 34 and be disposed between the manifold 46 and each pushrod so as to bias the pushrod toward the drive housing 20. Thus, when the rotating shaft 26 is not forcing the pushrod 34 downward away from the drive housing 20, the pushrod spring 38 can push the pushrod upward toward the drive housing.

In some embodiments, the drive housing 20 may include a check valve 74 between the fluid reservoir 45 and the tappet passage 33 at the fluid cavity 39 so as to provide selective fluid communication between a fluid reservoir and the fluid cavity. For example, in some embodiments, the check valve 74 is configured to allow fluid to flow into the fluid cavity 39 from the fluid reservoir 45 when the pressure within the fluid cavity is lower than the pressure within the fluid reservoir. The check valve 74, does not allow fluid to flow from the fluid cavity 39 into the fluid reservoir 45.

In some embodiments, the drive housing 20 also includes a vent channel 76 providing fluid communication between the tappet passage 33 and a drain annulus 77 between the drive housing and the bearing housing 18. When the base end 43 of the tappet 37 has traveled into an extended position below the vent channel 76, the vent channel will fluidly communicate with the fluid cavity 39 and provide an outlet for the fluid within the fluid cavity, into the drain annulus 77 in the interface between the drive housing 20 and the bearing housing 18, and into the fluid reservoir 45. Thus, the downward travel of the tappet 37 is restricted by the location of the vent channel 76.

In some embodiments, the drive housing 20 includes a seal vent 78 formed in the drive housing between the fluid reservoir 45 and each tappet passage 33 above a seal 11 disposed between each tappet 37 and the drive housing. The seal vents 78 function as escapes for relatively high pressure fluid forced into the interfaces between the tappets 37 and the drive housing 20 in the tappet passages 33. The seal vents 78 can limit the fluid pressure experienced by the seals 11 by allowing the relatively high pressure fluid to vent into the relatively low pressure fluid reservoir 45.

Referring to FIG. 2, the drive system 60 can also include a slipper 54 rotatably connected to the slipper end 44 of each piston 35. The slipper 54 is disposed between the slipper end 44 of each piston 35 and the angled face 31 of the shaft 26 such that the slipper slides along the angled face at a slipper interface 61 between the slipper and the angled face when the shaft rotates. As the shaft 26 rotates and the relative angle between the piston 35 and the angled face 31 changes, the slipper 54 swivels about a ball joint of the piston and remains substantially aligned with the angled face. Thus, as the shaft 26 rotates, the slipper 54 remains substantially aligned with the angled face 31 and transfers the downward force of the rotating angled face into force longitudinally downward into the piston 35.

In some embodiments, each piston 35 includes a piston fluid channel 62 formed between the cavity end 42 and the slipper end 44 of the piston. In the illustrated embodiment, the diameter of the piston fluid channel 62 tapers from a relatively large cavity end diameter 63 at the cavity end 42 of the piston 35 into a relatively narrow piston jet 65 at the slipper end 44 of the piston. Each piston fluid channel 62 provides fluid communication between the respective fluid cavity 39 and the respective slipper 54. In such embodiments, each slipper 54 may have a corresponding slipper fluid channel 66 formed substantially through the slipper. The slipper fluid channel 66 is in fluid communication with the piston fluid channel 62 as the slipper 54 swivels about the slipper end 44 of the piston 35. Thus, the piston fluid channel 62 and the slipper fluid channel 66 provide fluid communication between each fluid cavity 39 and each respective slipper interface 61 formed between each respective slipper 54 and the angled face 31 of the shaft 26. In some embodiments, each slipper 54 may include a fluid pocket 68 formed in the slipper along the slipper interface 61. The fluid pocket 68 is in fluid communication with the slipper fluid channel 66 and helps hold fluid to help lubricate the slipper interface 61.

In some embodiments, the drive system 60 can include a piston spring 70 disposed in the tappet passage 33 between the cavity end 42 of the piston 35 and the base end 43 of the tappet 37. The piston spring 70 substantially longitudinally spans the fluid cavity 39 and serves to bias the piston 35 upward toward the angled face 31 of the shaft 26. Thus, the piston spring 70 drives the piston 35 upward when the downward force applied by the angled face 31 is relieved by the rotation of the shaft 26.

In some embodiments, the drive system 60 can also include a substantially round retainer plate 80 having a guide orifice 82 formed through its center. The retainer plate 80 includes a slipper orifice 84 formed through the retainer plate radially outward from the guide orifice 82 configured to accommodate each slipper 54. Each slipper 54 may be disposed through a slipper orifice 84 of the retainer plate 80 such that the retainer plate secures each slipper annularly around the guide orifice 82. In such embodiments, a retainer spring 86 is disposed within the retainer bore 32 of the drive housing 20. The retainer spring 86 has a housing end 88 and a guide end 89, and is connected to a retainer base 90 of the drive housing at the housing end 88. The guide end 89 of the retainer spring 86 extends out of the retainer bore 45 and includes a retainer guide 92 and guide adapter 94. The guide adapter 94 connects to the guide end 89 of the retainer spring 86, and the retainer guide 92 connects to the guide adapter. The retainer guide 92 fits partially through and within the guide orifice 82 of the retainer plate 80. The retainer spring 86 biases the retainer plate 80 upward toward the shaft 26 so as to press each slipper 54 against the angled face 31 of the shaft. As the shaft 26 rotates and the slippers 54 follow along the surface of the angled face 31, the retainer plate 80 nutates about the retainer guide 92. Thus, combination of the retainer spring 86 and the retainer plate 80 functions to force the slippers 54 (and therefore the respective pistons 35) upward toward the angled face 31 of the shaft 26.

Figure 3:
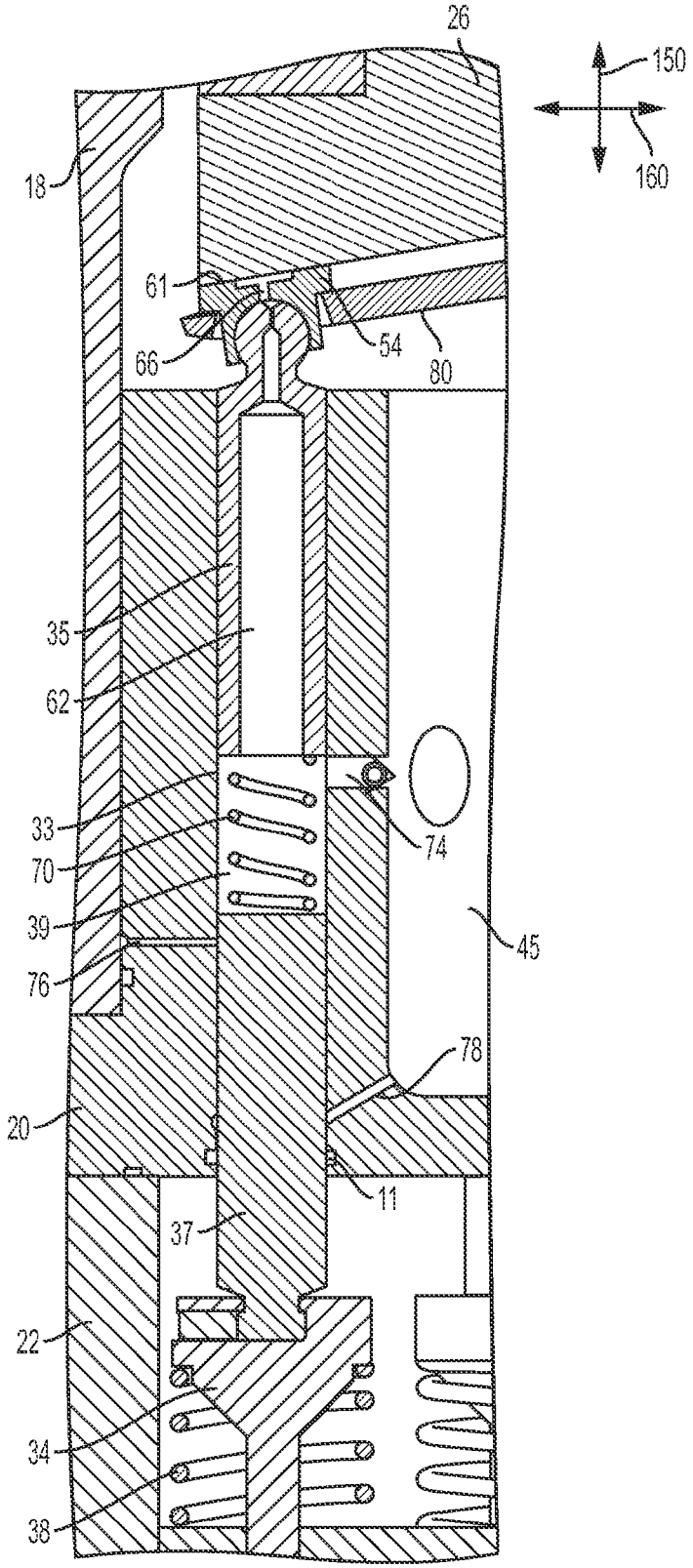
FIG. 3 is an enlarged partial side sectional view of the cryogenic pump of FIG. 1 showing a drive system in an extended position.
Figure 4:
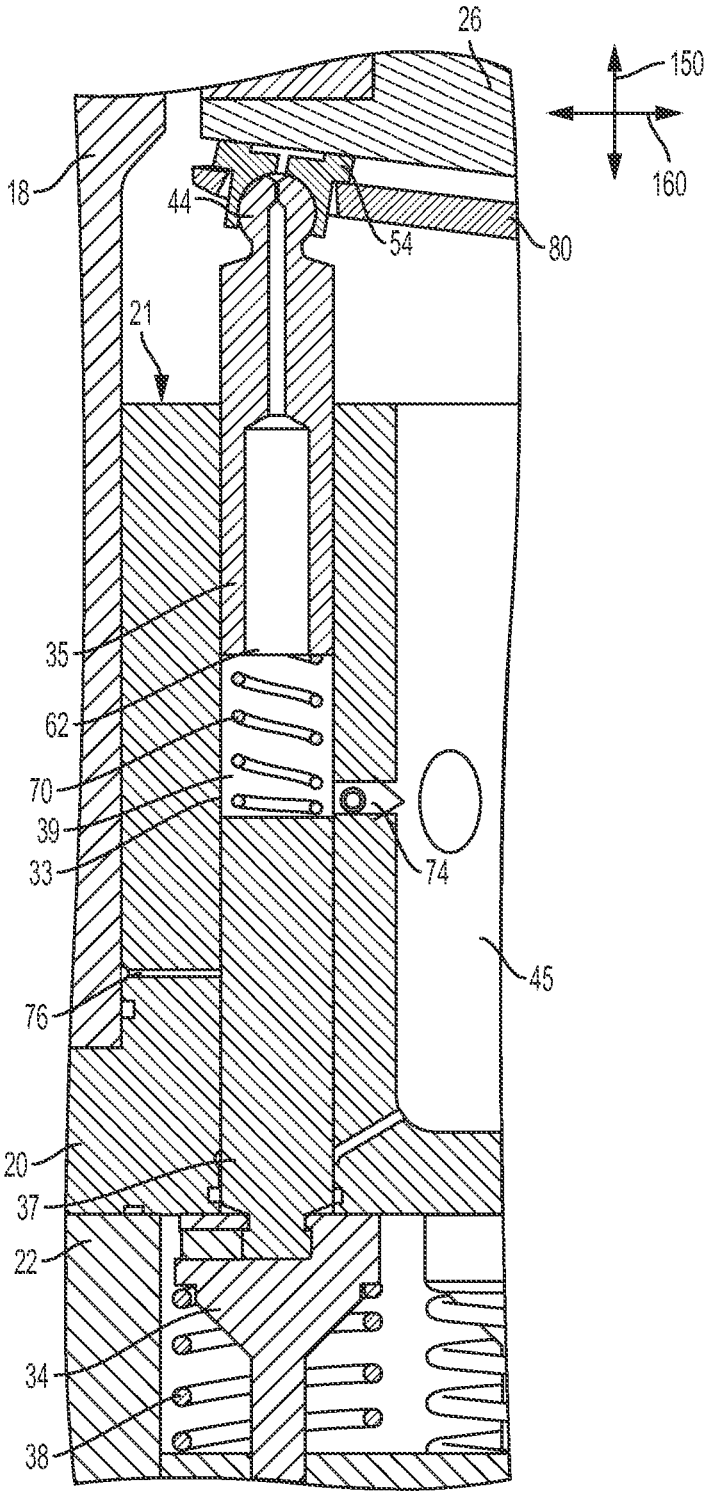
FIG. 4 is an enlarged partial side sectional view of the cryogenic pump of FIG. 1 showing a drive system in a retracted position.

Each piston 35, tappet 37, pushrod 34 combination in the drive system 60 alternatingly oscillates between an extended position and a retracted position as dictated by the rotation of the shaft 26. The extended position of one set of a piston, tappet, and pushrod of the drive system 60 is shown in FIG. 3, while the retracted position is shown in FIG. 4. In the illustrated embodiment, the extended position and the retracted position occur about 180 degrees out of phase with one another with respect to the rotation of the shaft 26. Thus, a full rotation of the shaft 26 can cause the piston 35, tappet 37, and pushrod 34 to cycle from a retracted position, through an extend stroke to an extended position, and then through a retract stroke back into a refracted position.

Referring now to FIG. 3, as the shaft 26 rotates and drives each piston 35 downward into the respective tappet passage 33 during an extend stroke, the fluid within the respective fluid cavity 39 is pushed against the base end 43 of the respective tappet 37, thereby driving the tappet to drive the respective pushrod 34 away from the drive housing 20 into the extended position. During the extend stroke, the piston 35 pressurizes the fluid within the fluid cavity 39 as it is pressed against the tappet 37, and the check valve 74 remains in the closed position. The tappet 37 is driven downward as a result. Additionally, when the pressure within the fluid cavity 39 exceeds the pressure of the fluid within the fluid reservoir 45, fluid within the fluid cavity and the piston fluid channel 62 is forced upward through the piston fluid channel, through the slipper fluid channel 66, and is forced into the slipper interface 61 between the slipper 54 and the angled face 31. Thus, as the angled face 31 is pressing down upon and sliding against the slipper 54, a layer of relatively high-pressurized fluid may be forced between the slipper and the angled face 31, providing lubrication. In this way, wear on the slipper 54 can be reduced. In some embodiments, when each tappet 37 reaches the extended position, the respective vent channels 76 provide an additional outlet for the pressurized fluid within the fluid cavity 39, restricting further downward movement of the tappet.

It should be understood that, though the diameters of the pistons 35 and the tappets 37 are illustrated herein as substantially equal, it is contemplated that, in some embodiments, the pistons and the tappets 37 could have differing diameters. In such embodiments, the tappet passage 33 has a corresponding variable diameter to accommodate the pistons and tappets. For example, in embodiments in which the piston 35 has a larger diameter than the tappet 37, hydraulic intensification allows for a shorter piston stroke to be used to force the tappet into the extended position. Such an embodiment can provide a more longitudinally compact drive system. In contrast, in embodiments in which the diameter of the piston 35 is less than the diameter of the tappet 37, although a longer piston stroke is used to force the tappet into the extended position, the respective slipper 54 would experience less force and, therefore, extend slipper life. Another reason to provide a piston 35 with a larger diameter than the tappet 37 could be to compensate for leakage out of the fluid cavity 39 during the extend stroke. In such an embodiment, the tappet 37 travel can be made to be substantially equal to the piston 35 travel even if some of the fluid within the fluid cavity 39 escapes. Additional reasons may exists to differ the diameters of the tappets 337 and pistons 35, such as to optimize pump performance by varying the diameters of the tappets and pistons with respect to one another.

Referring now to FIG. 4, when the force applied by the angled face 31 is relieved by the rotation of the shaft 26, each pushrod spring 38 drives the respective pushrod 34 toward the drive housing 20, thereby pushing the respective tappet 37 toward the piston end 21 of the drive housing during a retract stroke. In some embodiments, the fluid within the fluid cavity 39 is thereby pushed against the cavity end 42 of the piston 35, driving the slipper end 44 of the piston away from drive housing 20 and into the refracted position. In some embodiments, retraction of the piston 35 during the retract stroke is aided by either the piston spring 70, the retainer plate 80, or both. Although the drive system 60 illustrated herein includes both a piston spring 70 and a retainer plate 80, it is contemplated that only one or the other can be used in some embodiments. As described above, the piston spring 70 can be biased so as to push the piston 35 and slipper 54 substantially against the angled face 31 of the shaft 26 as the angled face recedes from the respective tappet passage 33. As also described above, in embodiments that include a retainer plate 80, the retainer plate can retain the slippers 54 substantially against the angled face 31 of the shaft 26 as the angled face recedes from the respected entry to the tappet passage 33. Thus, as the shaft 26 rotates into the retracted position as shown in FIG. 4, the retainer plate 80 pulls the slipper 54 and piston 35 away from the tappet 37.

In either embodiment, the upward travel of the pushrods 34 and the tappets 37 can be halted when the respective pushrod abuts the tappet end 23 of the drive housing, as shown in FIG. 4. During the retract stroke, fluid that may leak out of the fluid cavity 39 either through the vent channel 76 or through leakage between the piston 35 or tappet 37 and the drive housing 20 during the extend stroke can be replenished from the fluid reservoir 45. Specifically, if fluid has leaked from the fluid cavity 39, the volume of fluid within the fluid cavity may not be sufficient for the pushrod spring 38 to fully return the slipper 54 to the retract position against the angled face 31. Thus, as either the piston spring 70 or the retainer plate 80 pushes or pulls the slipper 54 and piston 35 away from the tappet 37, the fluid pressure within the fluid cavity 39 may drop relative to the fluid pressure within the fluid reservoir 45. As a result, the check valve 74 can move into the open position and allow fluid to flow from the fluid reservoir 45 into the fluid cavity 39 to replace the fluid lost from the fluid cavity during the extend stroke.

INDUSTRIAL APPLICABILITY

The drive system 60 of the present disclosure may be applicable to any type of fluid pumping system, and particularly to a pumping system that involves translating the motion of a rotating shaft into a reciprocating motion using a transverse face of the shaft or a swash plate. More particularly, the drive system 60 of the present disclosure may be applicable to applications involving cryogenic pumps. Moreover, the cryogenic pump disclosed may be used in any application requiring the pumping of a cryogenic fluid. For example, the cryogenic pump 10 of the present disclosure has particular applicability to the pumping of LNG at high pressures in fuel delivery systems for vehicles such as locomotives and large mining trucks.

The drive system 60 and cryogenic pump 10 of the present disclosure allows for simplification of construction and increased part reliability. For example, the drive system 60 of the present disclosure limits the bearings used to retain the shaft 26 within its housing, and improves the usable life of wear surfaces, such as the slippers 54. Additionally, the design of the present disclosure reduces the number of components used, resulting in a more compact pump. Thus, the drive system 60 and cryogenic pump 10 of the present disclosure can help to increase usable life by decreasing wear and can provide for a more compact size.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A cryogenic pump comprising:

a bearing housing having a shaft end and a drive end;

a shaft having an upper end and a lower end disposed in the bearing housing at the shaft end and rotatable with respect to the bearing housing about a longitudinal axis, the lower end of the shaft including an angled face oriented transverse to the longitudinal axis;

a drive housing having a piston end and a tappet end, the drive housing disposed at the drive end of the bearing housing, at least one tappet passage being formed through the drive housing substantially along the longitudinal axis between the piston end and the tappet end;

a pushrod housing connected to the tappet end of the drive housing;

at least one piston slidably disposed at least partially within the at least one tappet passage, a cavity end of the piston disposed within the tappet passage;

at least one tappet slidably disposed at least partially within the at least one tappet passage, the at least one tappet having a base end disposed within the tappet passage and a rod end extending below the tappet end of the drive housing, wherein a fluid cavity substantially filled with a fluid is formed in the tappet passage between the cavity end of the piston and the base end of the tappet;

at least one pushrod disposed within the pushrod housing and in contact with the rod end of the at least one tappet;

a manifold connected to the pushrod housing;

an insulator plate disposed between and secured by the manifold and the pushrod housing; and at least one pushrod spring positioned concentrically around and radially outward of the at least one pushrod, the at least one pushrod spring disposed between the insulator plate and a portion of the at least one pushrod so as to bias the at least one pushrod toward the drive housing;

wherein, during an extend stroke, the angled face of the shaft rotates and drives the at least one piston toward the tappet end of the drive housing so as to push the fluid within the fluid cavity against the base end of the at least one tappet thereby driving the at least one tappet to drive the at least one pushrod away from the drive housing into an extended position.

2. The cryogenic pump of claim 1, wherein during a retract stroke, the at least one pushrod spring drives the at least one pushrod toward the drive housing so as to push the tappet toward the piston end of the drive housing, thereby pushing the fluid within the fluid cavity against the cavity end of the at least one piston to drive a slipper end of the piston away from the drive housing and into a retracted position.

3. The cryogenic pump of claim 1, further comprising:

a slipper rotatably connected to a slipper end of the at least one piston opposite the cavity end and extending above the piston end of the drive housing, the slipper disposed between the at least one piston and the angled face of the shaft so as to slide along the angled face when the shaft rotates;

wherein the at least one piston includes a piston fluid channel running between the cavity end and the slipper end, and the slipper includes a slipper fluid channel in fluid communication with the piston fluid channel, the piston fluid channel and the slipper fluid channel providing fluid communication between the fluid cavity and a slipper interface formed between the slipper and the angled face of the shaft.

4. The cryogenic pump of claim 3, further comprising at least one piston spring disposed in the tappet passage between the cavity end of the piston and the base end of the tappet so as to bias the piston toward the angled face of the shaft.

5. The cryogenic pump of claim 3, further comprising:

a retainer plate having a guide orifice formed through the retainer plate and at least one slipper orifice formed through the retainer plate radially outward from the guide orifice, wherein the slipper is disposed through the at least one slipper orifice; and a retainer spring having a housing end and a guide end, the retainer spring disposed within a retainer bore formed in the piston end of the drive housing partially through the drive housing and connected to the drive housing at the housing end, the guide end of the retainer spring extending out of the retainer bore and disposed within the guide orifice of the retainer plate;

wherein the retainer spring biases the retainer plate toward the shaft so as to press the slipper toward the angled face of the shaft, and wherein the retainer plate is configured to nutate about the guide end of the retainer spring as the shaft rotates with respect to the bearing housing.

6. The cryogenic pump of claim 5, wherein the retainer spring includes a retainer guide on the guide end, and wherein the retainer plate nutates about the retainer guide.

7. The cryogenic pump of claim 1, further comprising at least one vent channel formed through the drive housing between the at least one tappet passage and a drain annulus, the at least one vent channel providing fluid communication between the fluid cavity and the drain annulus when the tappet is in the extended position so as to provide an outlet for the fluid within the fluid cavity and restrict downward movement of the tappet.

8. The cryogenic pump of claim 1, further comprising a check valve providing selective fluid communication between a fluid reservoir and the fluid cavity, the check valve configured to allow fluid to flow into the fluid cavity when the pressure within the fluid cavity is lower than the pressure within the fluid reservoir.

9. A drive system for a cryogenic pump including a bearing housing, a drive housing connected to the bearing housing, the drive housing having a piston end and a tappet end, and a pushrod housing connected to the piston end of the drive housing, the drive system comprising:

a shaft configured to rotate about a longitudinal axis within the bearing housing, the shaft having an upper end and a lower end, the lower end including an angled face oriented transverse to the longitudinal axis;

at least one piston configured to slide at least partially within a tappet passage formed between the piston end and the tappet end of the drive housing, a cavity end of the piston disposed within the tappet passage;

at least one tappet slidably disposed at least partially within the at least one tappet passage, the at least one tappet having a base end disposed within the tappet passage and a rod end extending below the tappet end of the drive housing, wherein a fluid cavity substantially filled with a fluid is formed in the tappet passage between the cavity end of the piston and the base end of the tappet; and at least one pushrod disposed within the pushrod housing and in contact with the rod end of the at least one tappet, the at least one pushrod configured to pump cryogenic fluid;

a manifold connected to the pushrod housing;

an insulator plate disposed between and secured by the manifold and the pushrod housing; and at least one pushrod spring positioned concentrically around and radially outward of the at least one pushrod, the at least one pushrod spring disposed between the insulator plate and a portion of the at least one pushrod so as to bias the at least one pushrod toward the drive housing;

wherein, during an extend stroke, the angled face of the shaft rotates and drives the at least one piston toward the tappet end of the drive housing so as to push the fluid within the fluid cavity against the base end of the at least one tappet thereby driving the at least one tappet to drive the at least one pushrod away from the drive housing into an extended position.

10. The drive system of claim 9, wherein during a retract stroke, the at least one pushrod spring drives the at least one pushrod toward the drive housing so as to push the tappet toward the piston end of the drive housing, thereby pushing the fluid within the fluid cavity against the cavity end of the at least one piston to drive a slipper end of the piston away from the drive housing and into a retracted position.

11. The drive system of claim 9, further comprising:

a slipper rotatably connected to a slipper end of the at least one piston opposite the cavity end and extending above the piston end of the drive housing, the slipper disposed between the at least one piston and the angled face of the shaft so as to slide along the angled face when the shaft rotates;

wherein the at least one piston includes a piston fluid channel running between the cavity end and the slipper end, and the slipper includes a slipper fluid channel in fluid communication with the piston fluid channel, the piston fluid channel and the slipper fluid channel providing fluid communication between the fluid cavity and a slipper interface formed between the at least one slipper and the angled face of the shaft.

12. The drive system of claim 11, further comprising at least one piston spring disposed in the tappet passage between the cavity end of the piston and the base end of the tappet so as to bias the piston toward the angled face of the shaft.

13. The drive system of claim 11, further comprising:

a retainer plate having a guide orifice formed through the retainer plate and at least one slipper orifice formed through the retainer plate radially outward from the guide orifice, wherein the slipper is disposed through the at least one slipper orifice; and a retainer spring having a housing end and a guide end, the retainer spring disposed within a retainer bore formed in the piston end of the drive housing partially through the drive housing and connected to the drive housing at the housing end, the guide end of the retainer spring extending out of the retainer bore and disposed within the guide orifice of the retainer plate;

wherein the retainer spring biases the retainer plate toward the shaft so as to press the slipper toward the angled face of the shaft, and wherein the retainer plate is configured to nutate about the guide end of the retainer spring as the shaft rotates with respect to the bearing housing.

14. The drive system of claim 9, wherein the drive housing further comprises at least one vent channel formed between the at least one tappet passage and a drain annulus, the at least one vent channel providing fluid communication between the fluid cavity and the drain annulus when the tappet is in the extended position so as to provide an outlet for the fluid within the fluid cavity and restrict downward movement of the tappet.

15. The drive system of claim 9, further comprising a check valve providing selective fluid communication between a fluid reservoir and the fluid cavity, the check valve configured to allow fluid to flow into the fluid cavity when the pressure within the fluid cavity is lower than the pressure within the fluid reservoir.

16. The drive system of claim 9, wherein a diameter of the at least one piston is different than a diameter of the at least one tappet.

17. A cryogenic pump comprising:

a bearing housing having a shaft end and a drive end;

a drive housing having a piston end and a tappet end, the drive housing disposed at the drive end of the bearing housing, at least one tappet passage being formed through the drive housing substantially along the longitudinal axis between the piston end and the tappet end;

a pushrod housing connected to the tappet end of the drive housing;

a manifold connected to the pushrod housing, the manifold forming at least one pushrod passage;

an insulator plate disposed between and secured by the manifold and the pushrod housing;

a shaft having an upper end and a lower end disposed in the bearing housing at the shaft end and rotatable with respect to the bearing housing about a longitudinal axis, the lower end of the shaft including an angled face oriented transverse to the longitudinal axis;

at least one piston slidably disposed at least partially within the at least one tappet passage, a cavity end of the piston disposed within the tappet passage and a slipper end of the piston extending above the piston end of the drive housing, the piston including a piston fluid channel running between the cavity end and the slipper end;

at least one tappet slidably disposed at least partially within the at least one tappet passage, the at least one tappet having a base end disposed within the tappet passage and a rod end extending below the tappet end of the drive housing, wherein a fluid cavity substantially filled with a fluid is formed in the tappet passage between the cavity end of the piston and the base end of the tappet;

at least one slipper rotatably connected to the slipper end of the at least one piston, the at least one slipper disposed between the piston and the angled face of the shaft so as to slide along the angled face when the shaft rotates, the slipper including a slipper fluid channel in fluid communication with the piston fluid channel, the piston fluid channel and the slipper fluid channel providing fluid communication between the fluid cavity and a slipper interface formed between the slipper and the angled face of the shaft;

at least one check valve providing selective fluid communication between a fluid reservoir and the fluid cavity, the check valve configured to allow fluid to flow into the fluid cavity when the pressure within the fluid cavity is lower than the pressure within the fluid reservoir;

at least one pushrod disposed within the pushrod housing and connected to the rod end of the at least one tappet, at least a portion of the at least one pushrod slidably disposed within the pushrod passage formed in the manifold;

and at least one pushrod spring positioned concentrically around and radially outward of the at least one pushrod, the at least one pushrod spring disposed between the insulator plate and a portion of the at least one pushrod so as to bias the at least one pushrod toward the drive housing;

wherein, during an extend stroke, the angled face of the shaft rotates and drives the at least one piston toward the tappet end of the drive housing so as to push the fluid within the fluid cavity against the base end of the at least one tappet thereby driving the at least one tappet to overcome the pushrod spring and drive the at least one pushrod away from the drive housing into an extended position;

wherein, during a retract stroke, the at least one pushrod spring drives the at least one pushrod toward the drive housing so as to push the tappet toward the piston end of the drive housing, thereby pushing the fluid within the fluid cavity against the cavity end of the at least one piston to drive the slipper end of the piston away from the drive housing and into a retracted position.

18. The cryogenic pump of claim 17, further comprising at least one piston spring disposed in the tappet passage between the cavity end of the piston and the base end of the tappet so as to bias the piston toward the angled face of the shaft.

19. The cryogenic pump of claim 17, further comprising:

a substantially round retainer plate having a guide orifice formed through the center of the retainer plate and at least one slipper orifice formed through the retainer plate radially outward from the guide orifice, wherein the at least one slipper is disposed through the at least one slipper orifice; and a retainer spring having a housing end and a guide end, the retainer spring disposed within a retainer bore formed in the piston end of the drive housing partially through the drive housing and connected to the drive housing at the housing end, the guide end of the retainer spring extending out of the retainer bore and disposed within the guide orifice of the retainer plate;

wherein the retainer spring biases the retainer plate toward the shaft so as to press the at least one slipper toward the angled face of the shaft, and wherein the retainer plate is configured to nutate about the guide end of the retainer spring as the shaft rotates with respect to the bearing housing.

* * * * *